United States Patent [19]

Schrader

[11] 4,140,564

[45] Feb. 20, 1979

[54] METHOD FOR CORRUGATING PAPERBOARD

[76] Inventor: Edward H. Schrader, 306 Ross Ave., Mart, Tex. 76664

[21] Appl. No.: 777,105

[22] Filed: Mar. 14, 1977

Related U.S. Application Data

[63] Continuation-in-part of Ser. No. 681,732, Apr. 29, 1976.

[51] Int. Cl.[2] ..... B31F 1/20

[52] U.S. Cl. ..... 156/205; 156/210; 264/286

[58] Field of Search ..... 156/205, 206, 208, 210, 156/289; 264/286; 425/369, 336

[56] References Cited

U.S. PATENT DOCUMENTS

| | | | |
|---|---|---|---|
| 1,796,542 | 3/1931 | Schoo | 156/205 |
| 2,029,390 | 2/1936 | Rodgers | 264/136 |
| 3,004,880 | 10/1961 | Lord | 156/210 |
| 3,103,459 | 9/1963 | Kane | 264/286 |
| 3,676,247 | 7/1972 | Morris et al. | 156/205 |
| 3,834,961 | 9/1974 | Terry | 156/289 |
| 3,849,224 | 11/1974 | Hintz et al. | 156/208 |
| 3,892,613 | 7/1975 | McDonald et al. | 156/205 |

FOREIGN PATENT DOCUMENTS 2336592 1/1975 Fed. Rep. of Germany.

*Primary Examiner*—William A. Powell
*Assistant Examiner*—William H. Thrower
*Attorney, Agent, or Firm*—Bard & Groves

[57] ABSTRACT

Improved method for corrugating paperboard, wherein a web of a corrugating medium is treated with a solid lubricant for a release agent and supplied to heated corrugating rolls to which a water mist has been applied evenly over the rolls. The web is shaped between the rolls by the application of pressure from the rolls and steam formed from the water spray. The availability of steam at the nip of the corrugating rolls provides improved flute formation and the solid lubricant allows the corrugated paperboard to release from the corrugating rolls without damage to the flutes. Standard corrugating equipment is enabled to operate at higher production rates and to accept lower quality paper for corrugating. Equipment is provided to maintain a supply of solid lubricant in a water suspension for application to the paperboard, preferably via a water spray directed on the corrugating rolls.

13 Claims, 1 Drawing Figure

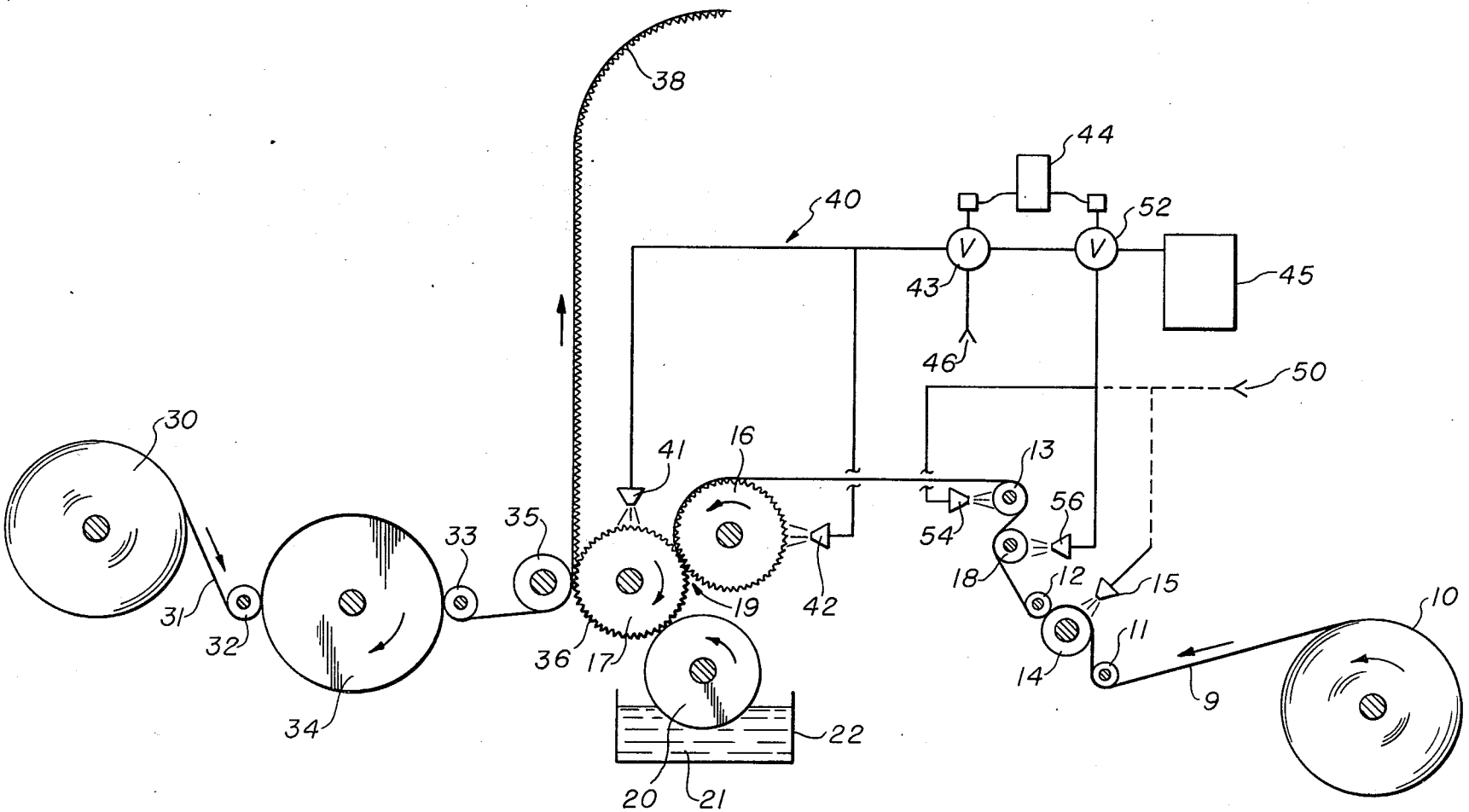
10
9
11
15
14
12
56
18
13
54
50
45
52
44
43
46
40
42
16
19
22
21
20
41
17
38
36
35
33
34
32
31
30

METHOD FOR CORRUGATING PAPERBOARD

RELATED CASES

This application is a continuation-in-part of application 681,732 filed Apr. 29, 1976.

BACKGROUND OF THE INVENTION

This invention relates to a method for forming corrugated paperboard and more particularly to a method and apparatus for forming corrugated paperboard at a high rate of speed and of high quality.

Systems currently in use for forming corrugated paperboard employ fluted corrugating rolls for corrugating a medium, generally paper drawn off of a roll, to form a corrugated layer. In order to facilitate corrugation and to ensure that corrugations are formed and retain their shape, the paper is generally first conditioned by the application of heat and one or more steam showers applied upstream of the corrugating rolls. The application of heat and steam is believed to "plasticize" the paper fibers to enhance flute formation in the corrugating rolls.

The conditioned corrugating medium is then passed through the corrugating rolls, which are generally heated to temperatures above 340° F., adhesive is applied to the crests of the corrugated paper flutes and paper linerboard or facing is applied to form a single faced corrugated paperboard. If desired, the single faced corrugated paperboard is then double faced in order to enhance the strength of the corrugated product. A second paper linerboard or facing is drawn over a preheating roller and joined with the exposed crests of the flutes of the single faced corrugated medium to which adhesive has been applied. The double faced corrugated paperboard is then passed over a heated surface or hot plate section while subjected to pressure from a weight roller and belt assembly above the hot plate section to cure the adhesive.

One problem in a conventional corrugating system is the occurrence of malformed flutes in the corrugated medium. When the corrugating medium is passed through the corrugating rolls, the corrugations are formed as the medium is pressed in the nip of the corrugating rolls under the application of heat and pressure to form flutes A low flute occurs when the flute does not fully form in the nip of the corrugating rolls. These malformed flutes have crests of uneven amplitudes which produce areas of little or no contact between the linerboard applied to the crests of the corrugated medium in subsequent double facing operations, thus forming a flawed corrugated product.

Another problem occurs when the flute are deformed in the removal of the corrugated medium from the corrugating rolls. Deformation during removal of the corrugated medium from the corrugating rolls results primarily from the inability of the corrugated medium to properly release from the corrugating rolls after the application of heat and pressure in the nip of the rolls. Such deformation substantially reduces the strength of the corrugation and results in a low quality product.

The paper available in today's market is frequently recycled paper and it is expected that more recycled material will be supplied in the future. This recycled paper retains some undesirable additives and/or contaminants and is also not always uniform in fiber content. The result is a paper medium which is difficult to corrugate using existing methods without greatly reducing the rate for producing the corrugated paperboard.

Malformed or deformed flutes result in a reduction in the strength of the corrugated product. In today's market, corrugated products are generally manufactured to conform to various industry and government specifications. The loss in product quality resulting from such malformed and deformed flutes results in rejected goods, customer complaints, and returned shipments. One way in which both of the above problems have been minimized according to the prior art is to run the corrugating system at a low rate of production. This low rate of production is, however, significantly below the speeds at which the corrugating machines are capable of operating and is basically an unsatisfactory method for solving the problem. Obiously, a higher rate of production results in a more cost competitive product.

The prior art has generally attempted to solve the flute malformation problem by preconditioning the corrugating medium with steam, using both a heated roll filled with steam with slots or outlets to release the steam across the width of the paper and a top steam shower. The fibers of the paper become softened and pliable as a result of this steam treatment. The steam, however, is applied some distance (several feet in most cases) before the paper enters the corrugating rolls and is therefore not completely effective at the nip of the corrugating rolls where the corrugations are formed.

In addition, the prior art has attempted to solve the flute deformation problem by the use of various "lubricants" applied to the corrugating medium or to the corrugating rolls. As shown in U.S. Pat. Nos. 1,796,542, 3,676,247, and 3,103,459, the "lubricants" chosen are generally of a hydrocarbon base such as paraffin, wax, or polyethylene. Such hydrocarbon base lubricants have been applied in liquid form or have been formed as a solid wax in solid bar form often being applied to the paper stock or to the crests of the corrugating rolls. Although these lubricants probably do reduce the coefficient of friction between the paper and the corrugating rolls, it is now believed that these materials actually act to further condition the paper by improving the flexibility of the paper fibers and produce some improvement in flute formation and higher operating speeds. However, the use of such hydrocarbon-base materials results in additional problems. Such materials have a tendency to be absorbed by the paper or linerboard with a resulting discoloration of the paper or linerboard. The hydrocarbon materials also tend to vaporize in an oily smoke under the operating temperatures of the corrugating rolls and the hot plates. This oil vapor can result in unacceptable concentrations of hydrocarbons in the plant atmosphere.

U.S. Pat. No. 3,676,247 further discloses a lubricant containing stearins for use in an unheated or low heat corrugating system but the wax base provided for the lubricant would be unacceptable in a heated system for the reasons discussed above. This reference discloses the use of stearins only in a low temperature system (below 320° F.) and only in combination with a hydrocarbon carrier. It will also be noted from the references that the lubrication is applied to either the corrugating medium itself or to the crests of the flutes of the corrugating rolls. The lubrication, when applied to the corrugating rolls, is thus only a topical application and is not evenly distributed over the surface of the flutes of the corrugating rolls.

One prior art reference, U.S. Pat. No. 3,849,224 to Hintz, discloses the application of water and water with a detergent directly to the corrugating rolls to act as a lubricant. However, Hintz teaches only the corrugation of a plastic coated paper at temperatures of about 210° F. where water is a known lubricant for plastic and the addition of a detergent acts as a surfactant to improve these lubricating properties. The water applied by Hintz does not, and can not, act to steam condition the plastic coated paper corrugating medium to reduce the occurrence of malformed flutes. Hintz has no application to the production of corrugated paperboard, where any application of water per se to the paperboard can produce extreme quality variations unless the water is carefully applied in limited amounts in specific areas of the process.

It should be noted that the paper and paperboard have been treated with various products such as metallic stearates to impart a finish or waterproofing to such paper products as typically shown in U.S. Pat. No. 2,029,390. Large quantities of the metallic stearates are required to obtain these altered paperboard characteristics and such applications have no bearing on the production of normal corrugated paperboard. Metallic stearates have also been used as release agents in metal casting and plastic molding operations. Such agents have not heretofore been applied in the paper corrugating industry to improve corrugating system performance.

The disadvantages of the prior art are overcome in the present invention, however, and improved methods and apparatus are provided for forming a single faced corrugated paperboard at increased production rates and with improved flute formation and reduced equipment operating costs.

SUMMARY OF THE INVENTION

In a preferred embodiment of the present invention, a web of a corrugating medium which may be treated with a solid lubricant as a release agent is supplied to heated corrugating rolls to which a water mist is applied evenly over the corrugating rolls. The corrugating medium is shaped into fluted paper between the corrugating rolls by the application of pressure from the corrugating rolls and steam formed in the pressure area of the corrugating rolls from the water spray. A first linerboard is then glued to one side of the corrugated medium. The water mist may be applied evenly to the corrugating rolls just ahead of the nip of the rolls and is transformed into steam which operates on the fibers of the corrugating medium directly in the nip of the corrugating rolls to provide improved flute formation and also imparts a cushioning effect between the corrugating rolls.

A solid lubricant which acts as a release agent may be carried by the corrugating medium or may be evenly applied over the surfaces of the flutes on the corrugating rolls to improve separation between the corrugated medium ad the corrugating rolls with a resulting decrease in the incidence of flute malformation and thereby obtain more uniform contact of flute crests with adhesive applicator roll.

It is contemplated by the present invention that the water spray on the corrugating rolls will produce only steam at the nip whereby the moisture content of the paper is not increased. Further, the solid lubricant is applied so as to transfer the solid lubricant to the corrugating paper or the corrugating rolls without actually wetting the paper with water. By using a solid lubricant in a water carrier, hydrocarbons are eliminated and there is no resulting discoloration of the linerboard or objectionable vapors caused from the use of hydrocarbon lubricants or carriers.

A principal feature of the present invention is to provide for the manufacture of corrugated paperboard at the maximum equipment production capabilities.

Another feature of the invention is to provide for the manufacture of corrugated paperboard with high quality flute formation at maximum equipment production capabilities.

Still another feature of the invention is to provide for release of the corrugated medium from the corrugating rolls without deformation of the flutes during operation of the corrugating equipment at maximum production capabilities.

An advantage of the present invention is decreased impact at the nip of the corrugating rolls due to the cushioning effect of the steam produced from the applied water mist with a resulting increase in corrugating roll life and decrease in noise level.

Another advantage of the present invention is the elimination of the contaminating effect of airborne hydrocarbon vapors which result from the use of hydrocarbon base lubricants.

BRIEF DESCRIPTION OF THE DRAWING

In order that the manner in which the above-recited advantages and features of the invention are obtained can be understood in detail, a more particular description of the invention may be had by reference to specific embodiments thereof which are illustrated in the appended drawing, which drawing forms a part of this specification. It is to be noted, however, that the appended drawing illustrates only typical embodiments of the invention which are not to be considered limiting in scope, for the invention may admit to further equally effective embodiments.

IN THE DRAWING

The FIGURE is a simplified schematic illustration of a basic corrugator single factor.

DETAILED DESCRIPTION OF THE PREFERRED EMBODIMENTS

Referring now to the FIGURE, there may be seen a simplified illustration of a basic corrugator single facer. More particularly, corrugating medium 9 is drawn from roll 10 around guide roller 11 and over bottom steam conditioner 14. Corrugating medium 9 is conditioned by first applying steam to corrugated medium 9 through bottom conditioner 14 so as to evenly condition corrugating medium 9. Corrugating medium 9 is further conditioned by the appication of a top steam shower through top conditioner 15 to further ensure an even conditioning of corrugating medium 9. Corrugating medium 9 is then drawn around guide rolls 12 and 18 and 13 onto first corrugating roll 16. Corrugating roll 16 may be internally heated by steam to an operating temperature of about 340°-365° F. Temperatures of corrugating rolls 16 and 17 may vary but are generally at least above 300° F. Corrugating medium 9 then passes between first corrugating roll 16 and second corrugating roll 17 and is pressed into the corrugating roll flutes with maximum pressure occurring at the nip region 19, the point of closest contact between first corrugating roll 16 and second corrugating roll 17, so as to conform to the contours of corrugating rolls 16 and 17. After passing through the nip 19, corrugated medium 36 releases from first corrugating roll 16 and is carried by the second corrugating roll 17 into contact with adhesive roll 20. Adhesive roll 20 picks up adhesive 21 from adhesive tank 22 so as to apply adhesive 21 to the crests of the flutes as now exist on the corrugated medium 36.

Water atomizing system 40 is provided to aid in flute formation and release of corrugated medium 36 from corrugating rolls 16 and 17. Water atomizing system 40 consists of one or more jet nozzles 41 which act to evenly apply a fine mist of water to corrugating roll 17 before corrugating roll 17 enters the nip 19, and one or more water jet nozzles 42 which act to evenly apply a fine mist of water to corrugating roll 16 before corrugating medium 9 passes onto corrugating roll 16.

Water atomizing system 40 may further comprise valve 43 and valve actuator 44 for providing a means to connect the nozzles 41 and 42 to water supply 46 or to means for applying a solid lubricant, as hereinbelow described, in a water carrier 45. Water atomizing system 40 may thereby be capable of injecting a fine mist of plain water through water jet nozzles 41 and 42. For single facing, a first linerboard 31 is drawn from roll 30 over adjustable wrap roller 32 and is preheated by passing over facing preheater 34. Facing preheater 34 is generally maintained at a temperature above 300° F. Linerboard 31 then passes around adjustable wrap roller 33 and between heated pressure roll 35 and corrugating roll 17 where the first linerboard 31 is pressed against the crests of the adhesive coated flutes of corrugated medium 36 ad secured by adhesive 21. Pressure roll 35 is additionally maintained at a temperature at least above 300° F. for causing sufficient heat to set adhesive 21 and secure linerboard 31 to corrugated medium 36. Typically, a temperature range of 340° F. to 370° F. is maintained.

The production capability of generally available corrugator single facer equipment is about 400–650 feet per minute (fpm), however the production rate actually achieved is considerably less than this when conventional techniques are used. Water atomizing system 40 is provided to assist the system production rate to achieve its mechanical capabilities. A fine water mist is uniformly and evenly added to corrugating rolls 16 and 17 by water jet nozzles 41 and 42 to aid in flute formation as corrugating medium 9 passes to the nip 19 of corrugating rolls 16 and 17. The applied moisture is carried into the nip region 19 by corrugating rolls 16 and 17, and is transformed into steam as a result of the high operating temperatures of corrugating rolls 16 and 17, and provides for the application of steam at the exact place where flute formation occurs in corrugating medium 9, that is, in the nip 19 of corrugating rolls 16 and 17. This simultaneous application of heat, steam, and pressure greatly enhances the flute formation and reduces the malformation of flutes even at higher operating speeds. Other advantages which are not immediately apparent are also obtained from the presence of steam at the nip since the steam pressure acts to cushion the impact of the corrugating roll flutes as the flutes mesh at the nip. The noise of the corrugating machine is reduced by the cushioning effect and thereby positively improves the working environment. Further, the cushion decreases the wear on the rolls and thereby increases the life of the rolls.

A means for maintaining a solid lubricant in a water carrier is provided for transferring a solid lubricant onto the corrugating medium. The solid lubricants are generally from a class of lubricants which produce a lubricating effect from crystalline structures which shear into thin, flat plates which slide over one another. Suitable solid lubricants include graphite, molybdenum disulfide and soaps. For purposes of the present invention, these solid lubricants not only decrease friction between the paper and the corrugating rolls, but act primarily to promote release of the paper from the corrugating rolls after flute formation has been obtained.

It should be noted that the water acts only as a carrier to either suspend the solid lubricant, or to provide a carrier in which the solid lubricant is dissolved or emulsified. The water vaporizes during contact with heated surfaces over which the paper passes, leaving a residue on either the paper or heated corrugating roll to obtain the desired results. Successful separation of paper from corrugating rolls operating at increased speeds has been obtained using such solid lubricants as graphite, molybdenum disulfide and metallic soaps such as metallic stearates. It is expected that other solid lubricants, as hereinabove defined, can also be used to obtain reduced flute deformation at increased operating speeds.

The proper release between corrugated medium 36 and corrugating rolls 16 and 17 is essential to maximizing the operating speeds at which quality corrugated paperboard production can be maintained. The concentration of solid lubricants required to achieve maximum production operating capability is small, being in the order of one-fourth to one-half percent by weight of water. The maximum concentration is limited by the need to maintain a substantially rough finish on the corrugated medium and to provide for proper adhesive 21 application. The water carrier for the solid lubricants vaporizes into steam and passes harmlessly into the atmosphere without being absorbed into the corrugating medium 9 or linerboard 31. It will be appreciated that the solid lubricants as herein described may be applied to both surfaces of the corrugating paper without interferring with application of adhesive to the flutes of the corrugated paper.

It should be noted that the solid lubricant may be applied to the corrugating medium in a variety of ways. In one embodiment, a means 45 for maintaining the solid lubricant in a water suspension, emulsion, or solution is conveniently interconnected with water jet nozzles 41 and 42 through valve 43 and the solid lubricant is applied first to corrugating rolls 16 and 17 for transfer to corrugating medium 9 to obtain proper release after flute formation.

Alternatively, the solid lubricant may be applied to the corrugating medium 9 by the manufacturer of the medium or may be applied prior to the medium entering the corrugating rolls 16 and 17. Referring to the FIGURE, the means 45 for maintaining the solid lubricant in a water suspension, emulsion, or solution, may be interconnected with the preconditioning steamers 14 and 15 to inject the solid lubricant onto the surfaces of corrugating medium 9 as it is plasticized by the heated steam. Steam supply 50 provides a dry steam for conditioning corrugating medium 9 without wetting the paper. Water carrying a suspended, emulsified or dissolved solid lubricant is introduced through controllable valve 52 into the dry steam so that the water is vaporized without significantly increasing the moisture content of the steam and the solid lubricant is carried onto paper 9 by the conditioning steam.

In yet another embodiment, nozzles 54 and 56 may be interconnected with the solid lubricant supply means 45 by a controllable valve means 52. The solid lubricant which is suspended, emulsified or dissolved in a water carrier is then sprayed through nozzles 54 and 56 onto heated rollers 13 and 18. The water carrier is vaporized upon contact with the heated rollers 13 and 18, leaving a small amount of solid lubricant as a residue on the surface of rollers 13 and 18. Corrugating medium 9 is then passed over the heated rollers 13 and 18 to transfer the residual solid lubricant to both surfaces of corrugating medium 9. The spray may be continuously applied or valve 52 may be intermittently actuated by control means 44 to maintain a desired amount of solid lubricant on the surface of heated rollers 13 and 18.

By application of solid lubricants in a water suspension, emulsion or solution, the use of various hydrocarbons such as waxes, paraffins and emulsified polyethylenes on the system components and on the paper surfaces has been eliminated. Such hydrocarbon compounds were generally absorbed into the paperboard fibers and often left discernable objectionable residues as the lighter hydrocarbon components vaporized. Further, the vaporization of such hydrocarbon components led to the generation of increased concentrations of hydrocarbon compounds in the atmosphere adjacent to the corrugating equipment. The elimination of such hydrocarbon vapors greatly reduces pollution levels in accordance with EPA and OSHA guidelines and directives. Pollution from airborne paper fibers is also reduced as the production of such fibers is minimized by the low frictional forces between the various paper components and the corrugating system components.

In yet another embodiment, nozzles 54 and 56 may be interconnected with the solid lubricant supply means 45 by a controllable valve means 52. The solid lubricant which is suspended, emulsified or dissolved in a water carrier is then sprayed through nozzles 54 and 56 onto heated rollers 13 and 18. The water carrier is vaporized upon contact with the heated rollers 13 and 18, leaving a small amount of solid lubricant as a residue on the surface of rollers 13 and 18. Corrugating medium 9 is then passed over the heated rollers 13 and 18 to transfer the residual solid lubricant to both surfaces of corrugating medium 9. The spray may be continuously applied or valve 52 may be intermittently actuated by control means 44 to maintain a desired amount of solid lubricant on the surface of heated rollers 13 and 18.

By application of solid lubricants in a water suspension, emulsion or solution, the use of various hydrocarbons such as waxes, paraffins and emulsified polyethylenes on the system components and on the paper surfaces has been eliminated. Such hydrocarbon compounds were generally absorbed into the paperboard fibers and often left discernable objectionable residues as the lighter hydrocarbon components vaporized. Further, the vaporization of such hydrocarbon components led to the generation of increased concentrations of hydrocarbon compounds in the atmosphere adjacent to the corrugating equipment. The elimination of such hydrocarbon vapors greatly reduces pollution levels in accordance with EPA and OSHA guidelines and directives. Pollution from airborne paper fibers is also reduced as the production of such fibers is minimized by the low frictional forces between the various paper components and the corrugating system components.

In the preferred process for producing corrugated paperboard, the corrugating paper is supplied from roll 10 and is first heated and steam conditioned by conventional conditioning steam showers 14 and 15. The conditioned paper 9 is then fed over the tips of a first corrugating roll 16. A supply 45 of solid lubricant in a water suspension, emulsion or solution is connected with valve 43 to mix with water supply 46 and provide a water spray carrying the solid lubricant at a predetermined concentration. The water and the solid lubricant are sprayed through nozzles 41 and 42 onto heated corrugating rolls 17 and 16, respectively. The water begins to form steam on the surface of the corrugating roll flutes and the steam is carried into the nip region 19 along with corrugating paper 9. The availability of steam exactly at the nip 19 acts to further condition the paper and conform the paper along the flute contours without fracture and malformation of the flutes thus formed. As the corrugated paper 36 passes out of the nip 19, adhesive is applied to the crests and linerboard 31 is attached. The solid lubricants perform a release function as the corrugated paperboard is removed from corrugating rolls 16 and 17. Corrugated paper 36 releases smoothly and properly contacts adhesive applicator roll 20 to maintain a good bond with linerboard 31 and without deformation of the well-formed flutes.

Numerous variations and modifications may obviously be made in the structure herein described without departing from the present invention. Accordingly, it should be clearly understood that the forms of invention herein described and shown in the accompanying drawing is illustrative only and is not intended to limit the scope of the invention.

What is claimed is:

1. A method for manufacturing faced corrugated paperboard which comprises the following steps:

supplying a web of a corrugating paper, heating a corrugating means to a surface temperature at least above 300° F.

spraying said heated corrugating means with a predetermined amount of water and at a location selected to vaporize said water and form steam between said corrugating means and said corrugating paper, corrugating said corrugating paper by the application of pressure and heat from said corrugating means in the presence of said steam formed on said corrugating means, and securing a linerboard to said corrugated paper.

2. The method described in claim 1, further including the step of transferring a solid lubricant to said corrugating paper prior to corrugating said paper to enhance release of the corrugated paper from said corrugating means.

3. The method described in claim 2, wherein the step of transferring said solid lubricant to said corrugating paper further comprises the steps of:

carrying said solid lubricant in a water base, spraying said solid lubricant in said water carrier onto said corrugating means prior to contact between said corrugating means and said corrugating paper to enhance release of said corrugating paper from said corrugating means.

4. The method described in claim 2, wherein the step of transferring said solid lubricant to said corrugating paper further comprises the steps of:

carrying said solid lubricant in a water base, mixing said water carrier with a dry steam to vaporize said water carrier, and spraying both sides of said corrugating paper with said steam to transfer said solid lubricant to said corrugating paper.

5. The method described in claim 2, wherein the step of transferring said solid lubricant to said corrugating paper further comprises the steps of:

carrying said solid lubricant in a water base, spraying said water carrier on a plurality of heated rollers to vaporize said water carrier and leave said solid lubricant on the surface of said heated rollers, and passing said corrugating paper over said heated rollers to transfer said solid lubricant to both surfaces of said corrugating medium.

6. The method described in claim 2, wherein the solid lubricant is composed of a crystalline material which obtains a lubricating effect from sliding thin, flat crystalline plates produced by friction shear forces, said solid lubricant adapted for spray application with water for acting as a release agent.

7. The method described in claim 6, wherein said solid lubricant is selected from a group consisting of metallic stearates, colloidal graphite and colloidal molybdenum disulfide in a water carrier.

8. The method described in claim 6, wherein said solid lubricant is selected from a group consisting of metallic stearates, colloidal graphite and colloidal molybdenum disulfide in a water carrier and applied in concentrations less than 1.5% by weight of water.

9. In a process for manufacturing corrugated paperboard by passing a heated paper between two corrugating rolls heated to at least above 300° F., applying adhesive to the corrugated paper and joining said corrugated paper to a linerboard, an improved process for corrugating said paper, wherein said improvement comprises the steps of:

spraying said heated corrugating rolls with a predetermined amount of water in a location selected to vaporize said water and form steam between said corrugating rolls and said corrugating paper, and corrugating said paper by the application of pressure and heat from said corrugating rolls in the presence of said steam formed on said corrugating rolls.

10. The improvements described in claim 9, further including the step of transferring a solid lubricant to said corrugating paper prior to corrugating said paper to enhance release of the corrugated paper from said corrugating rolls.

11. The improvements described in claim 10, wherein the step of transferring said solid lubricant to said corrugating rolls further comprises the steps of:

carrying said solid lubricant in a water base, spraying said solid lubricant in said water carrier onto said corrugating rolls prior to contact between said corrugating rolls and said corrugating paper to enhance release of said corrugating paper from said corrugating rolls.

12. The improvements described in claim 11, wherein the solid lubricant is composed of a crystalline material which obtains a lubricating effect from sliding thin, flat plates produced by friction shear forces, said solid lubricant adapted for spray application with water for acting as a release agent.

13. The improvement described in claim 11, wherein said solid lubricant is selected from a group consisting of metallic stearates, colloidal graphite and colloidal molybdenum disulfide in a water carrier.

* * * * *